US011500335B2

(12) United States Patent
Maruyama et al.

(10) Patent No.: US 11,500,335 B2
(45) Date of Patent: Nov. 15, 2022

(54) ELECTRONIC TIMEPIECE

(71) Applicant: CASIO COMPUTER CO., LTD., Tokyo (JP)

(72) Inventors: Hirohisa Maruyama, Fuchu (JP); Kosuke Hasegawa, Koganei (JP); Noriyuki Kitta, Tokyo (JP); Hirofumi Nagareda, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 678 days.

(21) Appl. No.: 16/101,576

(22) Filed: Aug. 13, 2018

(65) Prior Publication Data

US 2019/0079461 A1 Mar. 14, 2019

(30) Foreign Application Priority Data

Sep. 13, 2017 (JP) ..... JP2017-175800

(51) Int. Cl.
*G04C 3/14* (2006.01)
*G04G 9/00* (2006.01)
(Continued)

(52) U.S. Cl.
CPC ..... *G04C 3/14* (2013.01); *G04B 19/04* (2013.01); *G04C 3/146* (2013.01); *G04C 10/04* (2013.01);
(Continued)

(58) Field of Classification Search
CPC ..... G04C 3/14; G04C 3/146; G04B 19/04
See application file for complete search history.

(56) References Cited

U.S. PATENT DOCUMENTS

2011/0063953 A1* 3/2011 Hasegawa ..... G04C 3/146 368/80
2013/0176827 A1* 7/2013 Zaugg ..... G04B 19/268 368/15
(Continued)

FOREIGN PATENT DOCUMENTS

CN 2072695 U 3/1991
JP S51-108661 U 8/1976
(Continued)

OTHER PUBLICATIONS

First Office Action dated Apr. 1, 2020 received in Japanese Patent Application No. CN 201811069652.5 together with an English language translation.
(Continued)

*Primary Examiner* — Edwin A. Leon
*Assistant Examiner* — Jason M Collins
(74) *Attorney, Agent, or Firm* — Scully Scott Murphy & Presser

(57) ABSTRACT

An electronic timepiece includes a first display section including a first rotatable part and a processor. In the first display section, a predetermined number of display contents being a same display content is simultaneously displayed at predetermined angle intervals in a rotation angle range of the first rotatable part, wherein the predetermined number is two or more. The first display section makes a display pattern that shows change in the display content appear the predetermined number of times cyclically according to rotation of the first rotatable part. When causing the first display section to display a first display content of first display contents included in the display pattern, the processor selects an angular position from angular positions for the first display content in the predetermined number of display patterns, and causes the first rotatable part to rotate to the selected angular position.

6 Claims, 11 Drawing Sheets

(51) Int. Cl.

| | |
|---|---|
| ***G04B 19/04*** | (2006.01) |
| ***G04R 60/14*** | (2013.01) |
| ***G04C 10/04*** | (2006.01) |

(52) U.S. Cl.
CPC ..... *G04G 9/0005* (2013.01); *G04G 9/0064* (2013.01); *G04R 60/14* (2013.01)

(56) References Cited

U.S. PATENT DOCUMENTS

| | | | | |
|---|---|---|---|---|
| 2014/0247699 | A1* | 9/2014 | Sembritzki ..... | G04C 17/005 368/15 |
| 2018/0267474 | A1* | 9/2018 | Lagorgette ..... | G04G 21/04 |

FOREIGN PATENT DOCUMENTS

| | | | |
|---|---|---|---|
| JP | S52-053489 | Y | 12/1977 |
| JP | 2004-506175 | A | 2/2004 |
| JP | 2016508614 | A | 3/2016 |

OTHER PUBLICATIONS

Notice of Reasons for Refusal dated Aug. 31, 2021 received in Japanese Patent Application No. JP 2017-175800 together with an English language translation.

* cited by examiner

ELECTRONIC TIMEPIECE

CROSS-REFERENCE TO RELATED APPLICATIONS

This application is based upon and claims the benefit of priority from the prior Japanese Patent Application No. 2017-175800, filed on Sep. 13, 2017, the entire contents of which are incorporated herein by reference.

BACKGROUND OF THE INVENTION

1. Field of the Invention

The present invention relates to an electronic timepiece.

2. Description of the Related Art

There is an electronic timepiece which displays a date and time and other various types of information with rotational members, such as rotatable hands/indicators and a rotatable rotating plate, by changing their angles of rotation. By using a plurality of such rotational members, various types of information can be displayed simultaneously.

Examples of the various types of information to be displayed include values of current time in a predetermined region(s) in the world, measurement time about a stopwatch function and alarm time, a day of a week, a type of a display function, and various settings such as ON and OFF settings of alarm operation. Further, there is known a technique for displaying accurate information in an easy-to-see form while suppressing moving amounts of rotational members, by using a vernier scale (s). This technique is used to display information with high accuracy, for example, to display time in units of smaller than seconds. (Refer to JP 2004-506175 A.)

However, simple movements of rotational members to specific destinations to display various types of information about many functions are too simple to recognize change in the displayed various types of information.

SUMMARY OF THE INVENTION

According to an aspect of a preferred embodiment, there is provided an electronic timepiece including: a first display section (i) which includes a first rotatable part, (ii) in which a predetermined number of display contents being a same display content is simultaneously displayed at an interval of a predetermined angle in a rotation angle range of the first rotatable part, wherein the predetermined number is two or more, and (iii) which makes a display pattern that shows change in the display content appear the predetermined number of times cyclically according to rotation of the first rotatable part; and a processor, wherein when causing the first display section to display a first display content of a plurality of first display contents which is produced by the display content changing according to the rotation of the first rotatable part and included in the display pattern, the processor selects an angular position from among angular positions for the first display content in the predetermined number of display patterns which is produced by the display pattern appearing the predetermined number of times cyclically, and causes the first rotatable part to rotate to the selected angular position.

BRIEF DESCRIPTION OF THE SEVERAL VIEWS OF DRAWING

The accompanying drawings, which are incorporated in and constitute a part of the specification, illustrate embodiments of the invention, and together with the general description given above and the detailed description of the embodiments given below, serve to explain the principles of the invention, wherein.

DETAILED DESCRIPTION OF THE INVENTION

Hereinafter, a preferred embodiment is described on the basis of the drawings.

Figure 1:
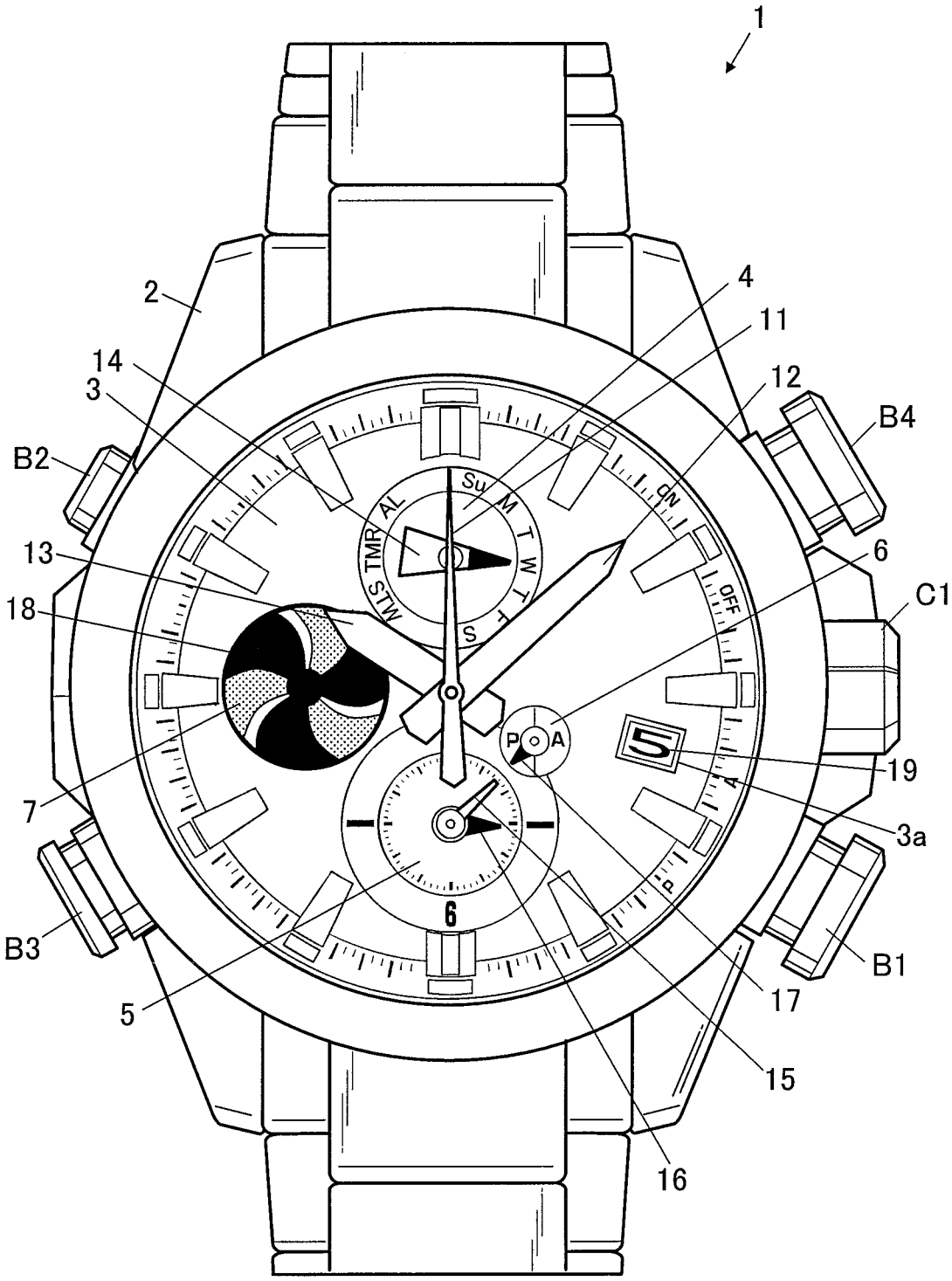
FIG. 1 is a front view of an electronic timepiece according to an embodiment.

FIG. 1 is a front view of an electronic timepiece 1 according to this embodiment.

Figure 2:
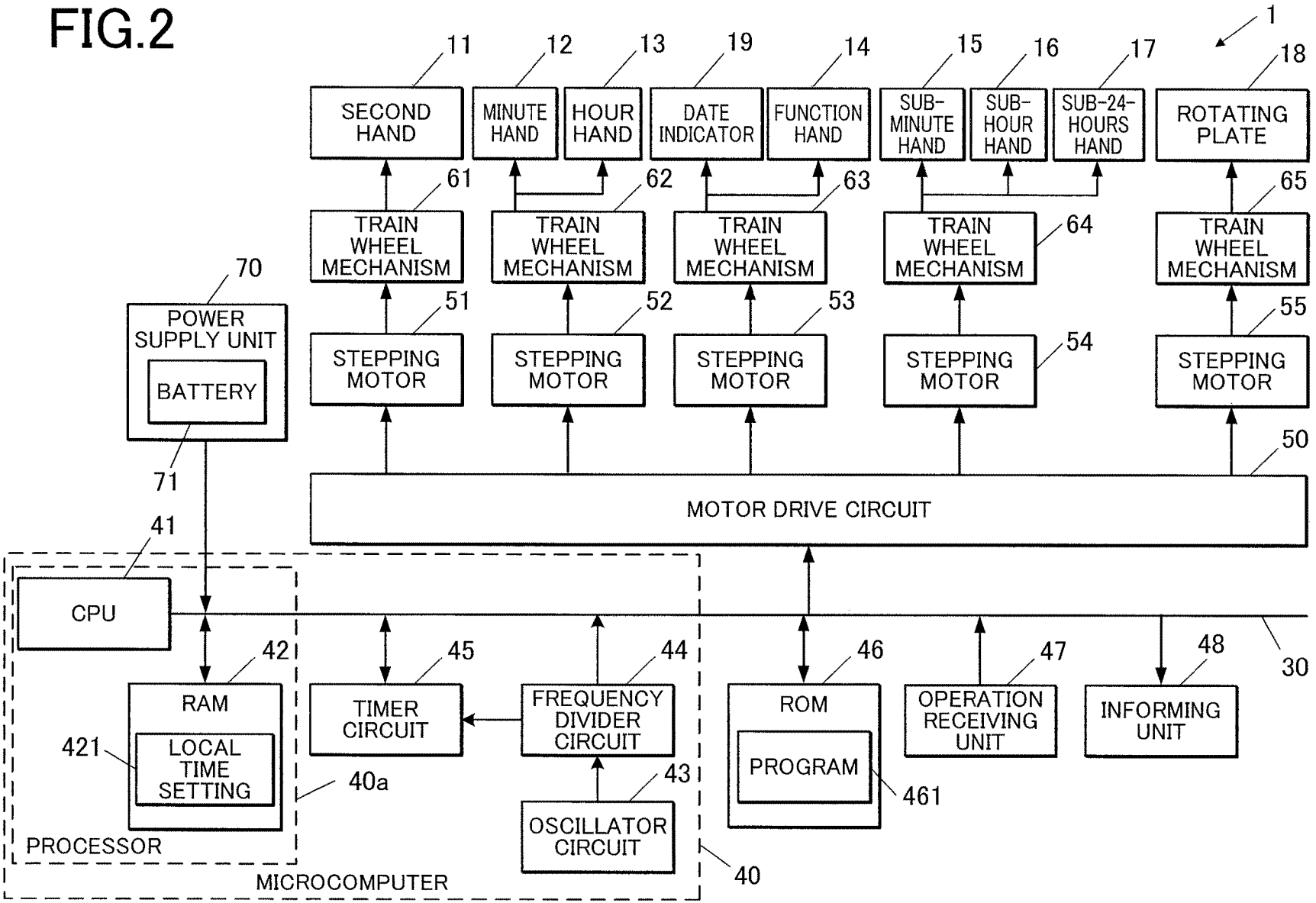
FIG. 2 shows a block diagram showing a functional configuration of the electronic timepiece.

FIG. 2 is a block diagram showing a functional configuration of the electronic timepiece 1.

As shown in FIG. 1, this electronic timepiece 1 is a watch which is worn on an arm or a wrist of a user with a not-shown belt attached to the upper end and the lower end of the electronic timepiece 1, and includes: a frame 2; a dial 3 arranged in the frame 2; a second hand 11, a minute hand 12, an hour hand 13, a function hand 14, a sub-minute hand 15, a sub-hour hand 16, a sub-24-hours hand 17 and a rotating plate 18 (first rotatable part) arranged on a display surface side (upper surface side) of the dial 3; a date indicator 19 arranged on the opposite side (lower surface side) to the display surface of the dial 3; and push button switches B1 to B4 and a crown C1 arranged on the lateral surface of the frame 2. Hereinafter, all or some of the second hand 11, the minute hand 12, the hour hand 13, the function hand 14, the sub-minute hand 15, the sub-hour hand 16, the sub-24-hours hand 17, the rotating plate 18 and the date indicator 19 may be collectively referred to as indicators 11 to 19 or the like.

The dial 3 and the indicators 11 to 18 are covered with a not-shown transparent crystal from the above. Further, in the frame 2, under the date indicator 19 (opposite to the surface facing the dial 3), components and a battery 71 (FIG. 2) for drive control of the electronic timepiece 1 are disposed and covered with a back cover.

The dial 3 is provided with a scale/indexes and marks for displaying time and other types of information about various functions. In the 3:30 direction (at the 3:30 position), an opening part 3*a* is formed such that date marks on the date indicator 19 can be exposed therein selectively. The dial 3 is also provided with small windows 4 to 7.

The indicators 11 to 19 rotate and thereby indicate and show display contents predetermined by their positional relationships with respect to the dial 3 (marks or scale). Contents corresponding to directions indicated by the hands 11 to 17 and angular positions of the rotating plate 18 and the date indicator 19 (a pattern exposed in the small window 7 and a mark exposed in the opening part 3*a*) are displayed.

The second hand 11, the minute hand 12 and the hour hand 13 are rotatably disposed in planes which are parallel to the dial 3 by taking an approximate center of the dial 3 as a rotation axis. These hands 11, 12 and 13 indicate seconds, minutes and hours, respectively, by their respective positional relationships with respect to the scale or indexes disposed on the circumference portion of the dial 3 for displaying time. The date indicator 19 is a rotatable disk member (ring-shaped member having a hole part at the center included) disposed on the lower surface side of the dial 3 to be parallel to the dial 3, and provided with date marks "1" to "31" which indicate dates arranged concyclically in order at predetermined intervals. By rotating the date indicator 19, one of the date marks is selected and exposed in the opening part 3*a*, so that information on a date for the time indicated by the hands 11 to 13 is shown.

The second hand 11 rotates by a predetermined angle in response to each step (each step operation) of a stepping motor 51, the step being transmitted to the second hand 11 via a train wheel mechanism 61, which is constituted of a plurality of gear wheels. The second hand 11 is used for displaying time, and may also be used for displaying an ON or OFF setting (marks "ON" and "OFF" disposed at positions of 8 seconds and 12 seconds on the dial 3, respectively) of the alarm operation, displaying a.m. or p.m. (marks "A" and "P" disposed at positions of 18 seconds and 22 seconds on the dial 3, respectively) of the time indicated by the minute hand 12 and the hour hand 13, setting a time zone in a local time setting (not shown but marks of city names and/or region names for respective local times may be disposed on the circumference portion of the dial 3, the bezel or the like), and so forth.

The minute hand 12 and the hour hand 13 rotate by their respective predetermined angles in response to each step of a stepping motor 52, the step being transmitted to the minute hand 12 and the hour hand 13 via a train wheel mechanism 62. The rotation angle of the hour hand 13 per step is 1/12 of the rotation angle of the minute hand 12 per step, and while the minute hand 12 moves 360 degrees (makes one full rotation) in 60 minutes, the hour hand 13 moves 30 degrees which corresponds to one hour.

The function hand 14 is rotatably disposed in the small window 4 which is disposed in the 12:00 direction of the dial 3. The function hand 14 is a hand for displaying a day of a week and an execution/operation state of each function executable in the electronic timepiece 1 of this embodiment. Examples of the executable function include an alarm function, a stopwatch function and a timer function. The function hand 14 rotates by a predetermined angle in response to each step of a stepping motor 53, the step being transmitted to the function hand 14 via a train wheel mechanism 63.

The date indicator 19 is linked with the function hand 14 and rotates, and displays a date with a date mark exposed in the opening part 3*a*. The function hand 14 does not move/rotate more than 360 degrees (one full rotation) in normal display operation, and the date mark which is displayed by the date indicator 19 as the position indicated by the function hand 14 changes hardly moves. In order to change the date mark exposed in the opening part 3*a* to another, the function hand 14 is fully rotated a predetermined number of times that is two or more.

The sub-minute hand 15 and the sub-hour hand 16 are rotatably disposed in the small window 5 which is disposed in the 6:00 direction of the dial 3. The sub-24-hours hand 17 is rotatably disposed in the small window 6 which is disposed in the 1:30 direction of the small window 5. These sub-minute hand 15, sub-hour hand 16 and sub-24-hours hand 17 (may be collectively referred to as sub-hands 15 to 17 or the like; a second rotatable part) are for displaying local time (world clock) simultaneously with the time indicated by the above-described hands 11 to 13, the local time being different from the time indicated by the hands 11 to 13. These sub-hands 15 to 17 are also used for displaying measurement time or remaining time when the stopwatch function or the timer function is in operation. The sub-hands 15 to 17 may also be used for setting and displaying time (alarm time) at which an alarm is sounded. The sub-hands 15 to 17 and the small window 5 constitute a second display section of the electronic timepiece 1 of this embodiment.

The sub-minute hand 15, the sub-hour hand 16 and the sub-24-hours hand 17 rotate by their respective predetermined angles in response to each step of a stepping motor 54, the step being transmitted to the sub-hands 15 to 17 via a train wheel mechanism 64. The rotation angle of the sub-hour hand 16 per step is 1/12 of the rotation angle of the sub-minute hand 15 per step, and the rotation angle of the sub-24-hours hand 17 per step is 1/2 of the rotation angle of the sub-hour hand 16 per step.

The rotating plate 18 is disposed in the small window 7 (fixed section) which is disposed in the 9:00 direction of the dial 3 in such a way as to be rotatable 360 degrees (rotation angle range). The rotating plate 18 is used, for example, for displaying ratios/proportions about various types of information, and rotates by a predetermined angle, for example, one degree, in response to each step of a stepping motor 55, the step being transmitted to the rotating plate 18 via a train wheel mechanism 65.

Figure 3A:
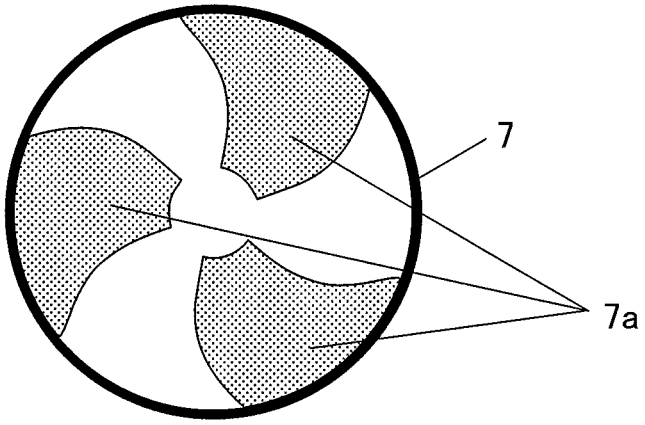
FIG. 3A shows a small window.
Figure 3B:
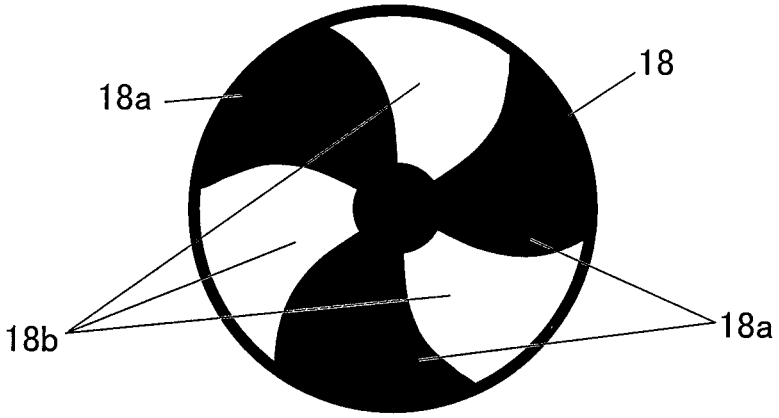
FIG. 3B shows a rotating plate.

FIG. 3A and FIG. 3B show the small window 7 and the rotating plate 18, respectively.

FIG. 4A to FIG. 4G show change in a display state according to a rotation state of the rotating plate 18.

As shown in FIG. 3A, in the small window 7, three area marks 7*a* (marks) each having an angular width of 60 degrees are defined at 120 degrees intervals, and colored or patterned differently from the other regions.

As shown in FIG. 3B, the rotating plate 18 is configured such that three fan-shaped parts 18*a* each having an angular width of 60 degrees are arranged at 120 degrees intervals with three gaps 18*b* (selective display parts) in between, the gaps 18*b* each having an angular width of 60 degrees (i.e. arranged in phase ranges which are the same in display patterns each shown in the region of 120 degrees). These fan-shaped parts 18*a* have the same planar-view shape as the area marks 7*a* in the small window 7. The three gaps 18*b* may be covered with transparent members. Further, the outer frame which connects the outer circumference portions of the three fan-shaped parts 18*a* with one another may not be provided.

The small window 7 and the rotating plate 18 constitute a first display section of this embodiment.

Figure 4A:
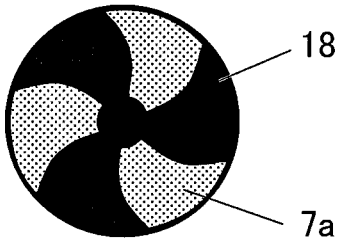
FIG. 4A to FIG. 4G show change in a display state according to a rotation state of the rotating plate.
Figure 4B:
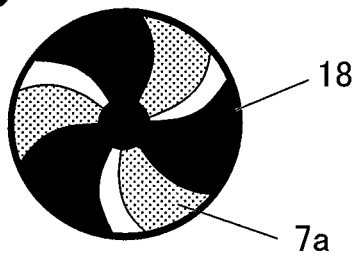
Figure 4C:
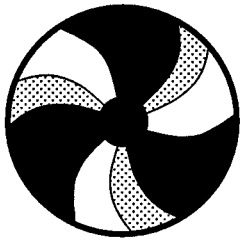
Figure 4D:
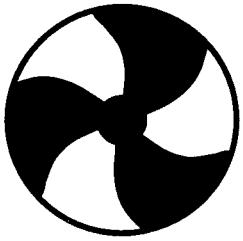

As shown in FIG. 4A, in a state in which the fan-shaped parts 18*a* are completely off (alternate with) the area marks 7*a* in the small window 7*a*, the area marks 7*a* are entirely exposed in the gaps 18*b*. As the fan-shaped parts 18*a* (the rotating plate 18) rotate in the small window 7, the three area marks 7*a* are gradually covered with and hidden by the three fan-shaped parts 18*a* as shown in FIG. 4B and FIG. 4C, and by 60-degree rotation, the area marks 7*a* are completely hidden under the fan-shaped parts 18*a* as shown in FIG. 4D.

Figure 4E:
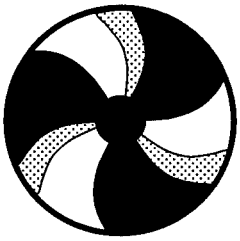
Figure 4F:
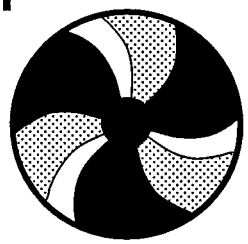
Figure 4G:
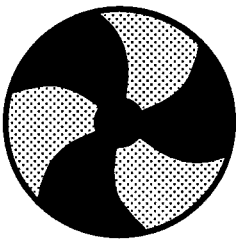

As the rotating plate 18 further rotates, the area marks 7*a*, which have been hidden by the fan-shaped parts 18*a* of the rotating plate 18, gradually reappear as shown in FIG. 4E and FIG. 4F, and by 120-degree rotation from the initial position, the area marks 7*a* are entirely exposed again as shown in FIG. 4G. By 360-degree rotation of the rotating plate 18, such change (display patterns) in the display state (three display contents which are the same and displayed simultaneously) is repeated (appears) three times (a predetermined number of times that is two or more) cyclically.

The stepping motors 51 to 55 can quickly move (fast-forward) the indicators 11 to 19 at up to 200 pps (Pulses per Second) in a clockwise direction and at up to 90 pps in a counterclockwise direction.

The push button switches B1 to B4 and the crown C1 are included in an operation receiving unit 47 and configured to receive input operations from the outside. The push button switches B1 to B4 receive press operations from the outside. The crown C1 receives rotation operations in a state of being pulled from its initial position. The operation receiving unit 47 detects press operations to the push button switches B1 to B4 and pulling operations, push-back operations and rotation operations to the crown C1, and outputs input signals corresponding to the types of the operations to a CPU 41.

As shown in FIG. 2, the electronic timepiece 1 includes, in addition to the above-described components, the CPU 41, a RAM (Random Access Memory) 42, an oscillator circuit 43, a frequency divider circuit 44, a timer circuit 45, a ROM (Read Only Memory) 46, an informing unit 48, a motor drive circuit 50 and a power supply unit 70 as components for the drive control. Between these components, commands and data are exchanged via a bus 30.

The CPU 41 performs various types of arithmetic processing and controls the whole operation of the electronic timepiece 1. In a normal time display mode, the CPU 41 causes the hands 11 to 13 to display time and causes the function hand 14 and the date indicator 19 to display a day of a week and a date corresponding to a date and time counted by the timer circuit 44. Further, the CPU 41 calls and executes a program to perform control for a function to operate, such as the stopwatch function, the timer function or the alarm function.

The ROM 46 stores a program 461 to control operation of the electronic timepiece 1, initial setting data and so forth. The ROM 46 may include an overwritable/updatable non-volatile memory, such as a flash memory. In this case, data may be additionally written and/or rewritten in response to change, update or the like of settings.

The RAM 42 is a volatile memory which provides the CPU 41 with a memory space for work, and stores temporary data and updatable setting data. An example of the updatable setting data is a local time setting 421 including location information on a location of a user. Other examples of the updatable setting data are the ON or OFF setting of the alarm operation and the alarm time.

The CPU 41 and the RAM 42 constitute a processor (controller) 40*a* of the electronic timepiece 1 of this embodiment.

The oscillator circuit 43 generates predetermined frequency signals and outputs the same to the frequency divider circuit 44. The oscillator circuit 43 may use a quartz oscillator, for example.

The frequency divider circuit 44 divides and converts the predetermined frequency signals input from the oscillator circuit 43 into frequency signals (clock signals) which the CPU 41 and so forth use for operation, and outputs the same. The frequency after the conversion may be changed in response to a control command or the like from the CPU 41.

The timer circuit 45 counts and keeps a current date and time on the basis of the clock signals input from the frequency divider circuit 44. The date and time kept by the timer circuit 45 may be obtained by calculating numerical values with a format unique to the electronic timepiece 1 or by keeping a standard date and time, such as a date and time in UTC (Coordinated Universal Time), in the year-month-date-hour-minute-second form.

The CPU 41, the RAM 42, the oscillator circuit 43, the frequency divider circuit 44 and the timer circuit 45 may be arranged on a single IC chip (microcomputer 40). The quartz oscillator used for the oscillator circuit 43 may be attached to the microcomputer 40 as an external component.

The operation receiving unit 47 detects a press state of each of the push button switches B1 to B4 and the pulling operations, the rotation operations and the push-back operations to the crown C1, converts the same into electric signals, and outputs the signals to the CPU 41.

The informing unit 48 performs predetermined informing for a user in response to control signals from the CPU 41. The informing unit 48 includes a beep generator which generates beeps and a vibration generator which generates vibrations. The beep generator and the vibration generator may use well-known components, such as piezoelectric elements and weighted motors.

The motor drive circuit 50 outputs drive voltage pulses at appropriate timings with appropriate widths in response to control signals input from the CPU 41. The drive voltage pulses are for driving the stepping motors 51 to 55 to make steps (perform step operations) (for driving rotors of the stepping motors 51 to 55 to rotate predetermined angles). The widths of the drive voltage pulses are appropriately adjustable by the control signals from the CPU 41. If a control signal for driving a plurality of stepping motors simultaneously is input, the motor drive circuit 50 outputs drive voltage pulses by appropriately shifting drive timings on the basis of the maximum load of the electronic timepiece 1 without causing any trouble.

The power supply unit 70 supplies power of the battery 71 to the components of the electronic timepiece 1. The battery 71 may be a solar panel which the electronic timepiece 1 has and a secondary cell which accumulates power generated by the solar panel, or may be a dry cell (e.g. a button cell) attachable/detachable to/from the power supply unit 70.

Next, display operation by the electronic timepiece 1 of this embodiment is described.

The electronic timepiece 1 displays, with the rotating plate 18, the remaining suppliable power (remaining battery power or remaining amount) of the secondary cell of the battery 71.

The CPU 41 obtains the remaining suppliable amount of the battery 71 by using, for example, a value of voltage output (output voltage value) from the power supply unit 70, and causes the rotating plate 18 to rotate such that the area marks 7*a* are exposed in the gaps 18*b* with a proportion (exposure percentage) corresponding to the ratio of the remaining amount to the storable amount (capacity) of the battery 71. In this embodiment, the area marks 7*a* and the other regions are displayed such that the other regions are continuous with the area marks 7*a* clockwise (FIG. 4B and FIG. 4C). The number of positions which the fan-shaped parts 18*a* can take for the exposure percentage (angular positions for one of the display contents included in the respective display patterns) is three in the rotation angle range of 360 degrees as described above. From among these three positions, one is selected which is the closest position to the start position of the display operation, the closest position in the clockwise direction, or the closest position (angular position to which the rotating plate 18 (fan-shaped parts 18*a*) reaches first) in a rotation direction (predetermined rotation direction) determined by the rotation/movement direction of a corresponding indicator (s), and the fan-shaped parts 18*a* are moved to the selected position. Alternatively, the rotating plate 18 may be rotated such that the fan-shaped parts 18*a* are moved to the second closest position to the start position of the display operation in any of the above-described rotation directions. Thus, additional 120-degree rotation enables more dynamic display without extending operation time more than necessary.

Figure 5:
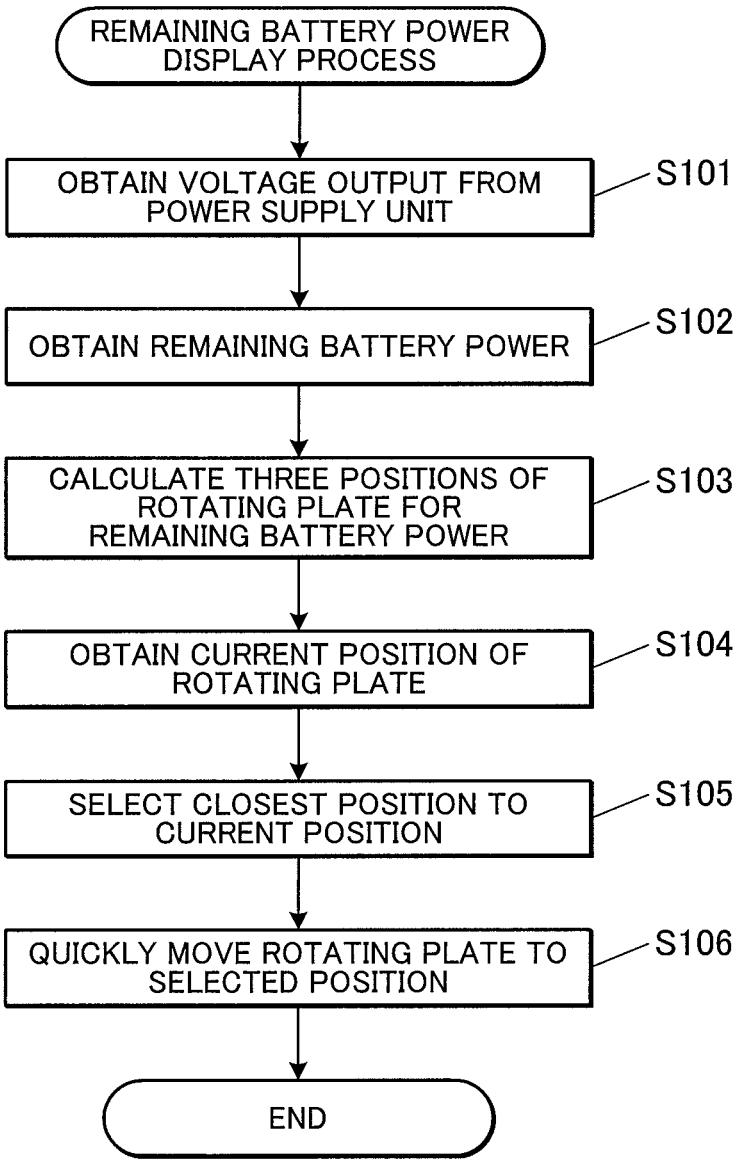
FIG. 5 is a flowchart showing a control procedure in a remaining battery power display process.

FIG. 5 is a flowchart showing a control procedure by the processor 40*a* (CPU 41) in a remaining battery power display process which is performed in the electronic timepiece 1 of this embodiment.

The remaining battery power display process is started when the operation receiving unit 47 receives a predetermined input operation for a remaining amount display command.

When the remaining battery power display process is started, the processor 40*a* (CPU 41) obtains a value of voltage output (output voltage value) from the power supply unit 70 (Step S101). The processor 40*a* obtains the remaining battery power on the basis of the output voltage value (Step S102). The relationship between the output voltage value and the remaining battery power is stored as a conversion table in the ROM 46, and the remaining battery power may be simply calculated from the conversion table, or may be calculated from the conversion table and corrected according to a temperature condition and/or used time (deterioration level of the battery 71). The number of levels indicating the remaining battery power is appropriately determined. That is, the number of levels may be three (HIGH, MIDDLE, LOW) or around, or may correspond to the number of numerical values (integer values) from a lowest limit to 100% inclusive within which the electronical timepiece 1 is operable. Alternatively, the remaining battery power may be displayed on the basis of the remaining operable time of the electronic timepiece 1 (i.e. when the amount corresponds to the lowest limit, "0" may be displayed).

The processor 40*a* calculates three positions (angular positions) of the rotating plate 18 for the remaining battery power (Step S103). The processor 40*a* obtains the current position of the rotating plate 18 (Step S104). The processor 40*a* selects, from among the calculated three positions of the rotating plate 18, one which is closest to the current position in the clockwise direction (Step S105). The processor 40*a* outputs a control signal to the motor drive circuit 50 to cause the stepping motor 55 to continuously operate to quickly move (fast-forward) the rotating plate 18 to the selected position (Step S106). The processor 40*a* then ends the remaining battery power display process. The processor 40*a* can keep displaying the remaining battery power for an appropriate period of time.

Further, in the electronic timepiece 1, the area marks 7*a* can be displayed with the exposure percentage of the area marks 7*a* being changed in tune with changes in the minute value (at least a portion of a cyclical change) of displayed time (every one minute) or movements of the minute hand 12 (every 10 seconds). For example, at an even o'clock, the area marks 7*a* are entirely hidden (FIG. 4D), every minute or every 10 seconds, the area marks 7*a* are gradually exposed according to the rotation of the rotating plate 18 (FIG. 4E and FIG. 4F), and in 60 minutes, namely, at an odd o'clock, the area marks 7*a* are entirely exposed (FIG. 4G and FIG. 4A). During a period of 60 minutes from the odd o'clock, the area marks 7*a* are gradually hidden according to the rotation of the rotating plate 18 (FIG. 4B and FIG. 4C), and at the next even o'clock, the area marks 7*a* are entirely hidden (FIG. 4D) again. That is, in this embodiment, the exposure state of the area marks 7*a* changes one cycle (rotation) by being linked with two cycles of change of the time of 60 minutes, namely, two 60-minute cycles (a predetermined cycle).

In this case, the processor 40*a* (CPU 41) outputs control signals to the motor drive circuit 50 to cause the rotating plate 18 to operate at the same time as, simply, the minute hand 12 operates, or at the same time as the minute hand 12 moves to each exact minute position (position for 0 second of each minute). This causes the rotating plate 18 to rotate 360 degrees, namely, make one full rotation, in six hours (three cycles).

Values of minutes are the same in many regions, and hence the rotating plate 18 performs display according to the minute value (minute hand 12) of the time displayed by the hands 11 to 13 too. However, if the rotating plate 18 is displaying, in a region having an hourly time difference with respect to UTC, time in a region having a time difference of 15 or 30 minutes about the world clock function, the rotating plate 18 displays the time in tune with the minute value of the world clock at a phase different from that of the hands 11 to 13 (minute hand 12).

Further, in the electronic timepiece 1, the rotating plate 18 can change what to display (display content) according to the display content of the sub-hands 15 to 17. If the sub-hands 15 to 17 are displaying a date and time of the world clock (time in a predetermined region), the rotating plate 18 performs display according to the minute value of the time of the world clock as described above. If the sub-hands 15 to 17 are counting elapsed time (predetermined counting time) about the stopwatch function, the rotating plate 18 performs display according to the minute value of the elapsed time. If the sub-hands 15 to 17 are counting set time about the timer function, the rotating plate 18 performs display according to the minute value of the remaining time to the set time. If the sub-hands 15 to 17 are used for setting the alarm operation or are displaying set time about the alarm function, the rotating plate 18 exposes or not expose the area marks 7*a* in the gaps 18*b* according to the ON or OFF setting of the alarm operation. The display by the rotating plate 18 about each of the world clock function, the stopwatch function, the timer function and the alarm function is performed together with the display by the sub-minute hand 15 or the second hand 11, and does not essentially require accurate reading of the angular position of the rotating plate 18 (exposure percentage of the area marks 7*a*) and is the operation for purposes including decorative purposes.

Figure 6:
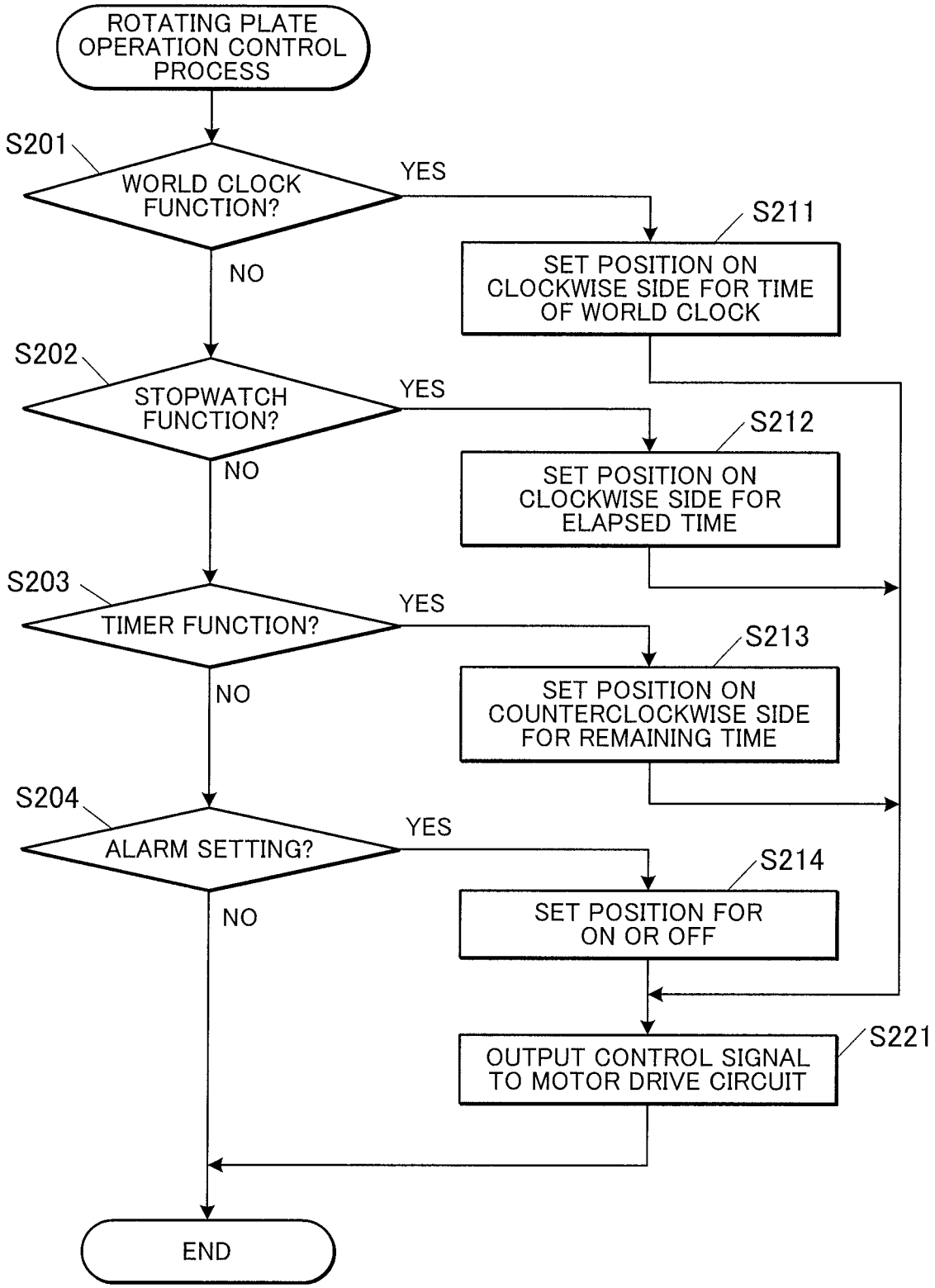
FIG. 6 is a flowchart showing a control procedure in a rotating plate operation control process for operation of the rotating plate corresponding to operation of sub-hands.

FIG. 6 is a flowchart showing a control procedure by the processor 40*a* (CPU 41) in a rotating plate operation control process for operation of the rotating plate 18 corresponding to operation (change in the display content) of the sub-hands 15 to 17, the rotating plate operation control process being performed in the electronic timepiece 1.

This rotating plate operation control process is performed when a program therefor is called in response to a command to operate the sub-hands 15 to 17 (i.e. a command to operate the stepping motor 54) being set (or in response to change in the minute value of the time displayed by the sub-hands 15 to 17).

When the rotating plate operation control process is started, the processor 40*a* (CPU 41) determines whether or not the world clock function is in operation (Step S201). When determining that the world clock function is in operation (Step S201: YES), the processor 40*a* sets the position of the rotating plate 18 for the current time of the world clock (Step S211). In Step S211, the processor 40*a* selects, from among the three positions described above, the position closest to the previous set position in the clockwise direction (angular position to which the rotating plate 18 reaches first). The processor 40*a* then proceeds to Step S221.

When determining that the world clock function is not in operation (Step S201: NO), the processor 40*a* determines whether or not the stopwatch function is in operation (Step S202). When determining that the stopwatch function is in operation (Step S202: YES), the processor 40*a* sets the position of the rotating plate 18 for the counting elapsed time (Step S212). If the previous set position is also a position about the stopwatch function, the processor 40*a* changes the set position in the clockwise direction from the previous set position. The processor 40*a* then proceeds to Step S221.

When determining that the stopwatch function is not in operation (Step S202: NO), the processor 40*a* determines whether or not the timer function is in operation (Step S203). When determining that the timer function is in operation (Step S203: YES), the processor 40*a* sets the position of the rotating plate 18 for the counting remaining time to the set time (Step S213). If the previous set position is also a position about the timer function, the processor 40*a* changes the set position in the counterclockwise direction from the previous set position. The processor 40*a* then proceeds to Step S221.

When determining that the timer function is not in operation (Step S203: NO), the processor 40*a* determines whether or not setting about the alarm function is in operation (i.e. is executed/performed) (Step S204). When determining that setting about the alarm function is in operation (Step S204: YES), the processor 40*a* sets the position of the rotating plate 18 for the ON setting or the OFF setting of the alarm operation (Step S214). In Step S214, for example, the processor 40*a* determines, as the set position, the closest position in the clockwise direction if ON is set or the closest position in the counterclockwise direction if OFF is set. The processor 40*a* then proceeds to Step S221.

When determining that setting about the alarm function is not in operation (Step S204: NO), the processor 40*a* ends the rotating plate operation control process.

When proceeding to Step S221 from any of Steps S211 to S214, the processor 40*a* outputs a control signal to the motor drive circuit 50 to rotate/move the rotating plate 18 to the determined set position (Step S221). The rotation/movement speed of the rotating plate 18 may be 90 pps to be the same as the maximum rotation/movement speed in the counterclockwise direction. The processor 40*a* can output this control signal at approximately the same time as outputting a control signal for the set command to move the sub-hands 15 to 17.

If the indicators 15 to 18 are rotated/moved in the counterclockwise direction, it may be necessary to cancel idling (adjust the backlash) of the indicators 15 to 18 corresponding to the play between gear wheels in the train wheel mechanisms 64 and 65, but for this operation, the processor 40*a* does not need to link the sub-hands 15 to 17 and the rotating plate 18 with one another. For example, it is possible that for the sub-hands 15 to 17, immediately after the end of the quick movement (fast-forwarding), the play is always cancelled for the rotation in the clockwise direction, whereas for the rotating plate 18, such a process may not be performed. Further, even if the processor 40*a* adjusts the backlash of both of them, the processor 40*a* does not need to make the number of steps of operation for the adjustment of the backlash the same. The processor 40*a* then ends the rotating plate operation control process.

Figure 7:
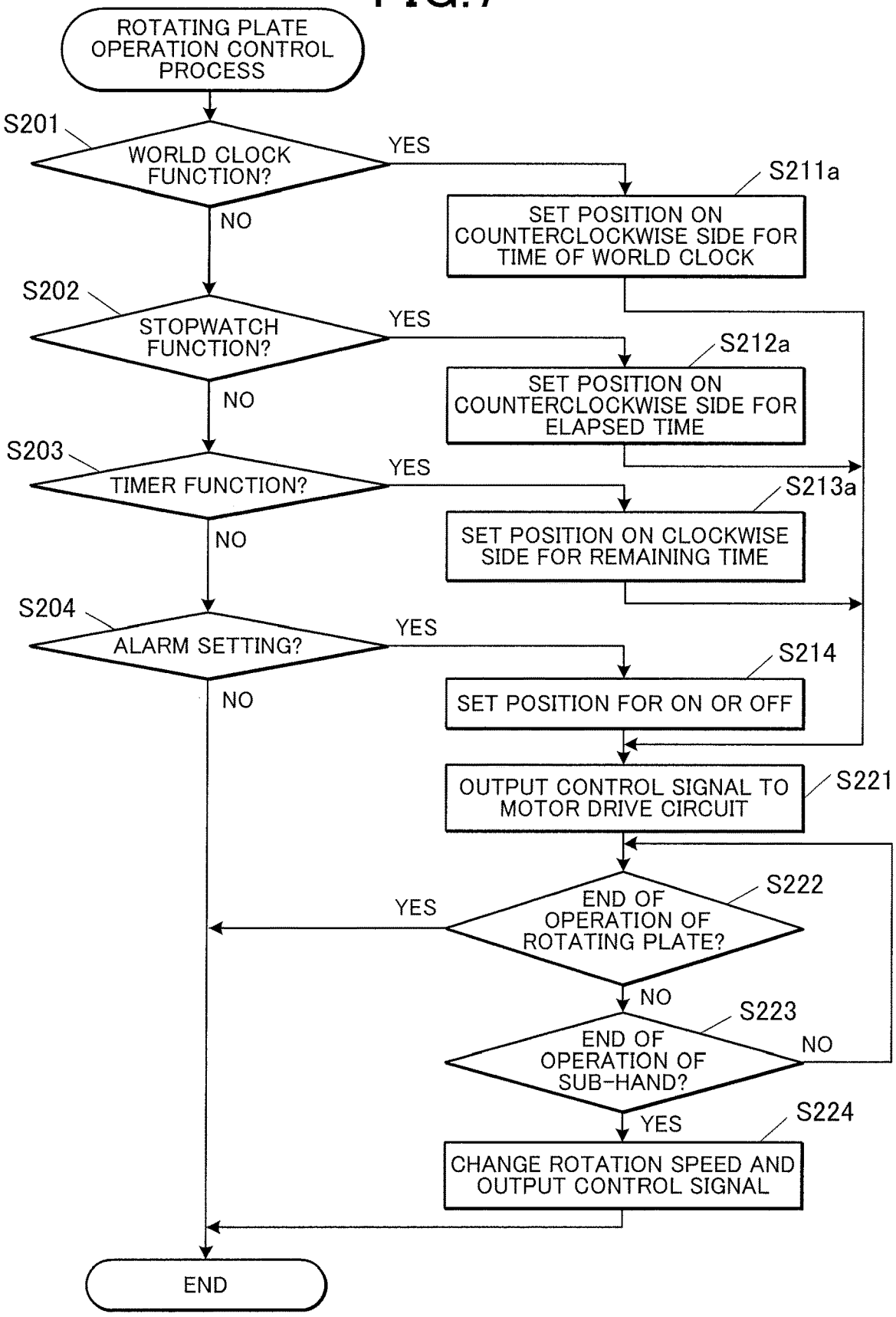
FIG. 7 is a flowchart showing a control procedure in a modified rotating plate operation control process.

FIG. 7 is a flowchart showing a control procedure by the processor 40*a* in a modified rotating plate operation control process.

This modified rotating plate operation control process is the same as the above rotating plate operation control process except that Steps S222 to S224 are added, and Steps S211*a*, S212*a* and S213*a* replace Steps S211, S212 and S213, respectively. The same steps (process contents) as the above are provided with the same reference numbers as the above, and their explanations are not repeated here.

In the modified rotating plate operation control process, the speed of the quick movement (fast-forwarding) of the rotating plate 18 can be changed if both the sub-hands 15 to 17 and the rotating plate 18 perform the quick movements of multiple steps, linking with one another. Further, although in the above rotating plate operation control process, in conjunction with rotation of the sub-hands 15 to 17, when the world clock function or the stopwatch function is in operation, the processor 40*a* causes the rotating plate 18 to rotate/move in the clockwise direction, and when the timer function is in operation, the processor 40*a* causes the rotating plate 18 to rotate/move in the counterclockwise direction, the processor 40*a* may cause the rotating plate 18 to rotate/move in the opposite directions to the above. That is, this makes the rotation directions of the sub-hands 15 to 17 and the rotating plate 18, which rotate approximately simultaneously, opposite to one another. In the case where the rotating plate 18 rotates in the counterclockwise direction, the positional relationship between the area marks 7*a* and the other regions, which are exposed according to the rotation of the rotating plate 18, becomes opposite to that in the case where the rotating plate 18 rotates in the clockwise direction (e.g. FIG. 4F replaces FIG. 4B).

When Step S201 is YES, the processor 40*a* sets the position of the rotating plate 18 for the current time of the world clock (Step S211*a*). In Step S211*a*, the processor 40*a* selects, from among the three positions described above, the position closest to the previous set position in the counterclockwise direction (angular position to which the rotating plate 18 reaches first). The processor 40*a* then proceeds to Step S221.

When Step S202 is YES, the processor 40*a* sets the position of the rotating plate 18 for the counting elapsed time (Step S212*a*). If the previous set position is also a position about the stopwatch function, the processor 40*a* changes the set position in the counterclockwise direction from the previous set position. The processor 40*a* then proceeds to Step S221.

When Step S203 is YES, the processor 40*a* sets the position of the rotating plate 18 for the counting remaining time to the set time (Step S213*a*). If the previous set position is also a position about the timer function, the processor 40*a* changes the set position in the clockwise direction from the previous set position. The processor 40*a* then proceeds to Step S221.

After Step S221, the processor 40*a* determines whether or not the rotating plate 18 has finished rotating (Step S222). When determining that the rotating plate 18 has finished rotating (Step S222: YES), the processor 40*a* ends the rotating plate operation control process.

When determining that the rotating plate 18 has not finished rotating yet (Step S222: NO), the processor 40*a* determines whether or not the sub-hands 15 to 17 have finished rotating (Step S223). When determining that the sub-hands 15 to 17 have not finished rotating yet (Step S223: NO), the processor 40*a* returns to Step S222. When determining that the sub-hands 15 to 17 have finished rotating (the sub-hands 15 to 17 have finished changing the display content, namely, time required by the rotating plate 18 for the rotation is longer than time required by the sub-hands 15 to 17 for the rotation) (Step S223: YES), the processor 40*a* changes the rotation speed of the rotating plate 18, and outputs a control signal to the motor drive circuit 50 to rotate the rotating plate 18 (Step S224). The speed after being changed is not particularly limited, but here, is higher than the speed before being changed. The processor 40*a* then ends the rotating plate operation control process.

Modifications

Next, modifications of the components for cyclically displaying a pattern in the electronic timepiece 1 of this embodiment are described.

Figure 8A:
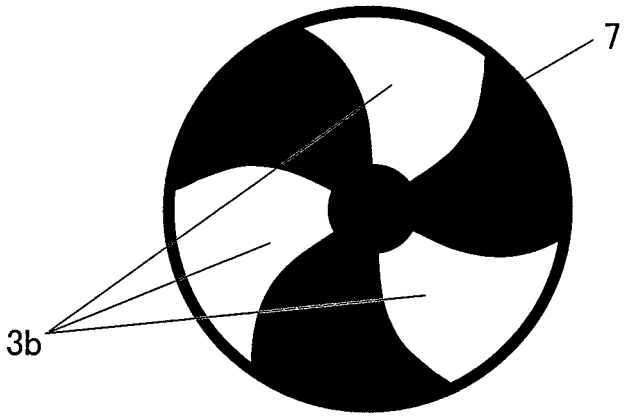
FIG. 8A is an illustration to explain a component for cyclically displaying a pattern according to a first modification.
Figure 8B:
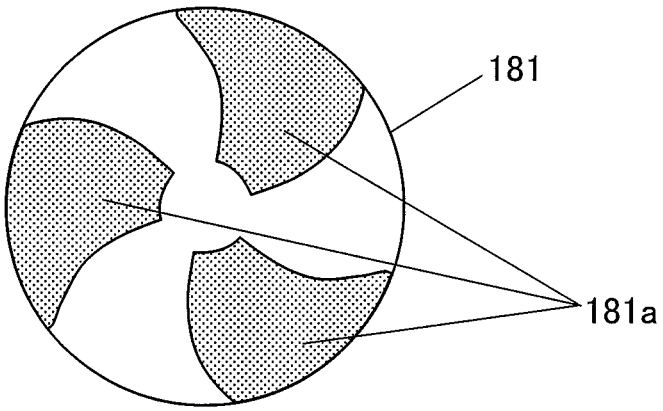
FIG. 8B is an illustration to explain a component for cyclically displaying a pattern according to the first modification.

FIG. 8A and FIG. 8B are illustrations to explain components for cyclically displaying a pattern according to a first modification.

In the first modification, as shown in FIG. 8A, in the small window 7, three fan-shaped opening parts 3*b* (selective instruction parts which constitute a part of the fixed section) each having an angular width of 60 degrees are arranged at 120 degrees intervals (corresponding to display intervals of the display patterns) (i.e. arranged in phase ranges which are the same), and a rotating plate 181 (FIG. 8B, the first rotatable part) which rotates under the small window 7 (on the back surface side of the dial 3) is provided.

On the upper surface (front surface side) of the rotating plate 181, fan-shaped figure patterns 181*a* (marks) each having an angular width of 60 degrees are drawn at 120 degrees intervals (corresponding to the display intervals of the display patterns). In the electronic timepiece 1 of the first modification, the rotating plate 181 and the opening parts 3*b* constitute the first display section.

In the first modification, the rotating plate 181 rotates in relation to the opening parts 3*b*. This changes the relative positional relationship between the figure patterns 181*a* and the opening parts 3*b*, and accordingly changes the proportion of the figure patterns 181*a* exposed in the opening parts 3*b*. Thus, even if the rotating plate 181 arranged under the small window 7 rotates in relation to the fixed opening parts 3*b* arranged above the rotating plate 181, the same display as that in the embodiment can be performed.

Figure 9A:
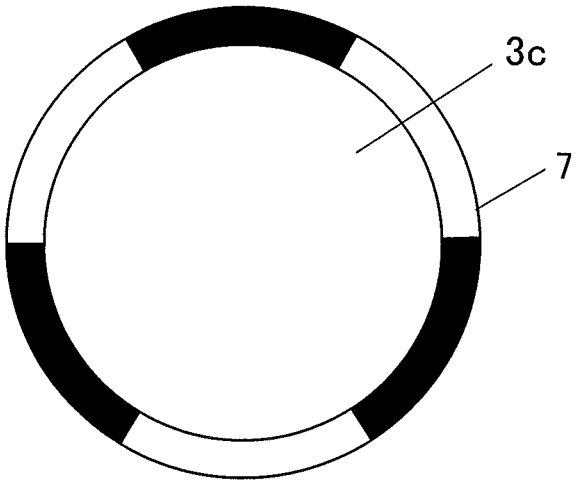
FIG. 9A is an illustration to explain a component for cyclically displaying a pattern according to a second modification.
Figure 9B:
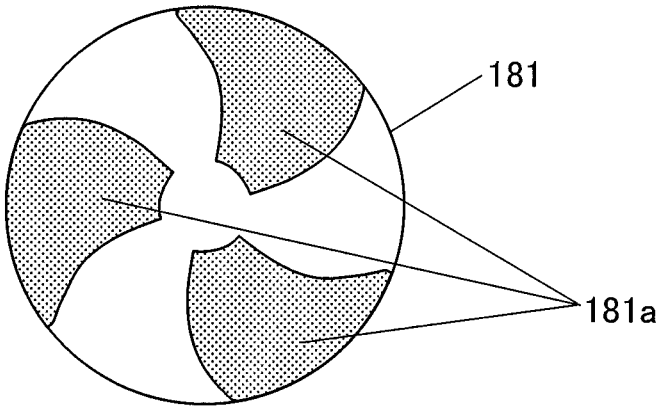
FIG. 9B is an illustration to explain a component for cyclically displaying a pattern according to the second modification.

FIG. 9A and FIG. 9B are illustrations to explain components for cyclically displaying a pattern according to a second modification.

In the second modification, as shown in FIG. 9A, in the small window 7 in the 9:00 direction, a plain circular opening part 3*c* is formed, and in it, the rotating plate 181 (FIG. 9B) disposed on the lower surface side of the dial 3 rotates. Around the opening part 3*c*, colored marks each having an angular width of 60 degrees are arranged with gaps of 60 degrees in between. On the front surface (surface to be exposed in the opening part 3*c*) of the rotating plate 181, the three figure patterns 181*a* are drawn at 120 degrees intervals.

The rotating plate 181 may be disposed on the upper surface side of the dial 3. In this case, the opening part 3*c* is unnecessary, and the colored marks are arranged on the circumference portion of the small window 7 defined on the dial 3. Further, in this case, instead of the rotating plate 181, the rotating plate 18 in the embodiment may be provided. Display is performed with the positional relationship between the figure patterns 181*a*, which rotate as the rotating plate 181 rotates, and the colored marks.

Figure 10A:
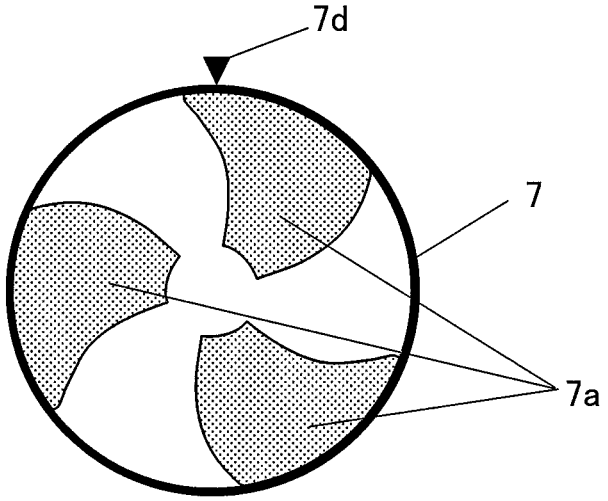
FIG. 10A is an illustration to explain a component for cyclically displaying a pattern according to a third modification.
Figure 10B:
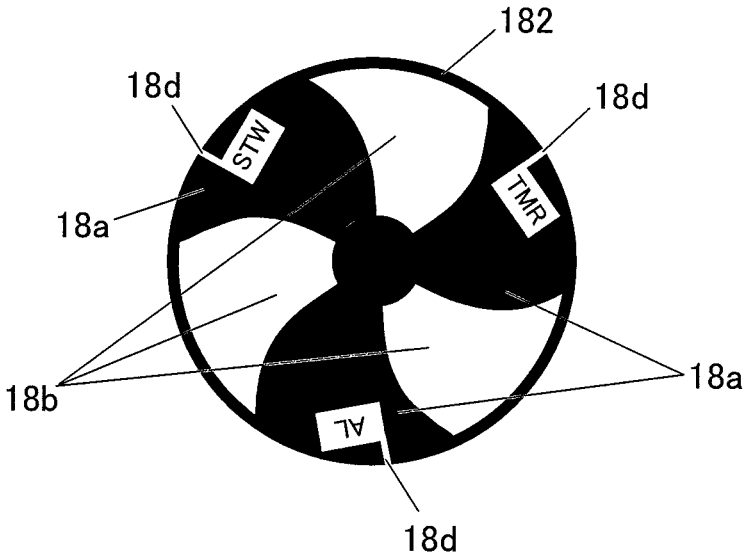
FIG. 10B is an illustration to explain a component for cyclically displaying a pattern according to the third modification.

FIG. 10A and FIG. 10B are illustrations to explain components for cyclically displaying a pattern according to a third modification.

In the third modification, as shown in FIG. 10A, a position mark 7*d* is disposed in the 12:00 direction of the small window 7 of the embodiment, and as shown in FIG. 10B, the three fan-shaped parts 18*a* of a rotating plate 182 are provided with marks 18*d* different from one another. As described above, if display is performed with the exposure percentage of the area marks 7*a*, the display can be performed with a combination of the three gaps 18*b* and the three area marks 7*a*, namely, without taking the positions of the marks 18*d* into account. Meanwhile, any one of the marks 18*d* can be indicated by aligning the mark 18*d* with the position mark 7*d*. Thus, the electronic timepiece 1 may be provided with a display section which can perform both the display taking all directions of 360 degrees into account and the display taking any of the three cycles (three display patterns) at 120 degrees intervals.

Figure 11A:
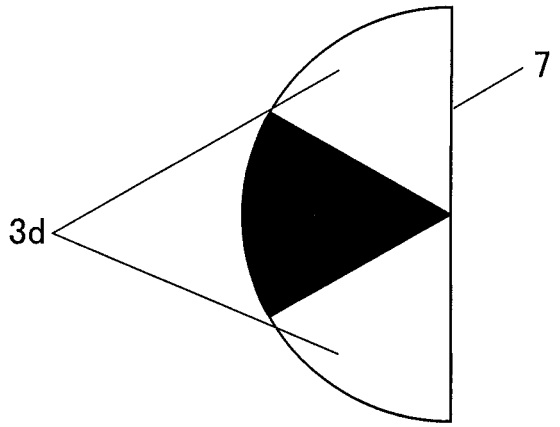
FIG. 11A is an illustration to explain a component for cyclically displaying a pattern according to a fourth modification.
Figure 11B:
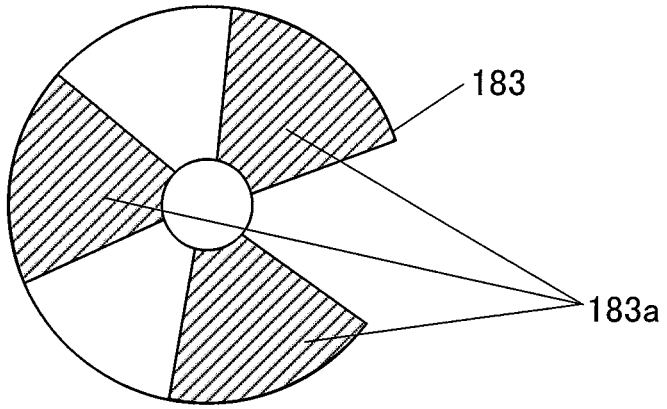
FIG. 11B is an illustration to explain a component for cyclically displaying a pattern according to the fourth modification.

FIG. 11A and FIG. 11B are illustrations to explain components for cyclically displaying a pattern according to a fourth modification.

In the fourth modification, as shown in FIG. 11A, two opening parts 3*d* each being arc-shaped and having an angle of 60 degrees are arranged with a gap of 60 degrees in between in the small window 7 on the dial 3. Of a rotating plate 183 which rotates on the lower surface side of the dial 3, areas corresponding to the opening parts 3*d* are exposed in the opening parts 3*d*. As shown in FIG. 11B, the rotating plate 183 is a 5/6 circle (300 degrees) and accordingly arc-shaped. The rotating plate 183 has three figure patterns 183*a* arranged at 120 degrees intervals. The three figure patterns 183*a* are each disposed in the region of 60 degrees. The rotating plate 183 shuttles in the rotation angle range of 300 degrees. Such a shape and an operation range too enable the same display as that in the embodiment by the rotation/movement direction being appropriately reversed.

As described above, the electronic timepiece 1 of the embodiment includes: the first display section (the rotating plate 18 and the small window 7) including the rotatable rotating plate 18 and the three area marks 7*a*; and the processor 40*a* (the CPU 41 and the RAM 42). The three area marks 7*a* are disposed at an interval of 120 degrees (a predetermined angle) in 360 degrees as a rotation angle range of the rotating plate 18, and simultaneously display the same display content by predetermined proportion parts thereof being exposed. The first display section makes a display pattern appear three times (a predetermined number of times that is two or more) cyclically according to rotation of the rotating plate 18. In the display pattern, the exposure percentage of (each of) the area marks 7*a* increases from 0%, to 100% and then returns to 0%. When causing the first display section to display a first display content (exposure percentage) of a plurality of first display contents which is produced by the display content changing according to the rotation of the rotating plate 18 and included in the display pattern, the processor 40*a* selects an angular position from among angular positions for the first display content in the three display patterns which are produced by the display pattern appearing the predetermined number of times cyclically, and causes the rotating plate 18 to the selected angular position.

Thus, the area marks 7*a* for three cycles are disposed in the rotation angle range of the rotating plate 18. Hence, the same result is simultaneously displayed and changed at three points by the display operation. Consequently, the electronic timepiece 1 can perform more user-friendly (easy-to-understand) display.

Further, the electronic timepiece 1 includes the small window 7 including the three area marks 7*a* cyclically disposed at 120 degrees intervals for the three display patterns, wherein the rotating plate 18 includes the gaps 18*b* which selectively display the area marks 7*a* and the other regions in the phase ranges being the same in the respective three display patterns.

Thus, by the rotation of the rotating plate 18 having the three gaps 18*b* disposed at 120 degrees intervals, the exposure percentages of the corresponding area marks 7*a* change equally. Consequently, the electronic timepiece 1 can display information corresponding to the exposure percentage (s) in a more large-scale way, and allows a user to know the display content (s) more physically.

Further, as described in the first modification, the electronic timepiece 1 includes the small window 7 including the opening parts 3*b* disposed at 120 degrees intervals corresponding to the display intervals of the three display patterns (the figure patterns 181*a* and gaps therebetween), wherein the rotating plate 181 includes the three figure patterns 181*a* cyclically disposed at 120 degrees intervals, and the processor 40*a* causes the first display section to display a desired first display content with the relative positional relationship between the rotating plate 181 and the small window 7 (opening parts 3*b*).

Thus, the electronic timepiece 1 can perform the same display with the same effects even if shapes and/or positions of the component to rotate and the component to be fixed are exchanged (FIG. 3A, FIG. 3B, FIG. 8A and FIG. 8B).

Further, the opening parts 3*b* of the small window 7 selectively display the three figure patterns 181*a* and the gaps therebetween of the rotating plate 18 in the phase ranges being the same. Thus, the electronic timepiece 1 selects and exposes necessary portions, and accordingly can show change in the display state to a user in a more easy-to-see way and more effectively.

Further, the electronic timepiece 1 includes the second display section (the sub-hands 15 to 17 and the window 5) which displays a second display content according to angular positions of the rotatable sub-hands 15 to 17, wherein the processor 40*a* causes the first display section to display at least a portion of a cyclical change of the second display content displayed by the second display section by linking, in the embodiment or modifications, two cycles of the minute value (120 minutes) with one cycle of the display patterns produced by the first display section including the rotating plate 18 (120-degree rotation of the rotating plate 18).

Thus, the electronic timepiece 1 causes the first display section including the rotating plate 18 to change the display state at the same time as causing the sub-hands 15 to 17 to directly indicate accurate numerical values to be readable, and accordingly can perform, in changing the display content (s), not only simple movements of the hands/indicators to their destinations but also more large-scale and easy-to-see display with visual effects. Further, the electronic timepiece 1 can perform more dynamic display. Still further, in the case where reading of accurate information with the hands/indicators is unnecessary, the electronic timepiece 1 allows a user to readily know an outline of the display content more physically by the exposure percentage.

Further, when causing the second display section including the sub-hands 15 to 17 to display the second display content according to predetermined counting time, such as the time of the world clock or the counting time of the stopwatch, the processor 40*a* causes the first display section including the rotating plate 18 to display at least a portion (minute value) of the second display content. Thus, the electronic timepiece 1 displays the display content that cyclically changes as time elapses by both the rotation of the rotating plate 18 and the rotation of the sub-hands 15 to 17, and accordingly allows a user to know the elapsed time more physically.

Further, the predetermined counting time includes time (local time) in a predetermined region. That is, even if a user does not use the stopwatch function, the timer function or the like aggressively, the electronic timepiece 1 routinely shows change in the exposure percentage according to the rotation of the rotating plate 18, and accordingly allows a user to easily see the changing state of the display content that changes as time elapses.

Further, the processor 40*a* causes the first display section including the rotating plate 18 to change the first display content as the second display section including the sub-hands 15 to 17 changes the second display content, and if time required by the rotating plate 18 for the change is longer than time required by the sub-hands 15 to 17 for the change, changes the rotation speed of the rotating plate 18 so as to be different between before and after the second display section finishes changing the second display content.

Thus, the electronic timepiece 1 performs more dynamic display by putting additional change to the operation of the rotating plate 18 without significantly extending time for the display operation, and accordingly can reduce monotonousness.

Further, the processor 40*a* causes the rotating plate 18 to rotate, among the angular positions for the first display content displayed by the first display section including the rotating plate 18 in the display patterns including the three area marks 7*a*, to the angular position to which the rotating plate 18 reaches first from the current angular position in a predetermined rotation direction.

Thus, the electronic timepiece 1 causes the rotating plate 18 to rotate, among the angular positions included in the three regions, into which the rotating plate 18 is divided, for the display content, to the closest angular position, and accordingly does not extend time for the change more than necessary. Further, determining the rotation direction in advance can reduce a sense of uniformity in the display operation.

Further, as described in the modified rotating plate operation control process, the processor 40*a* causes the rotating plate 18 to rotate to the angular position to which the rotating plate 18 reaches first from the current angular position in a rotation direction opposite to the rotation direction of the sub-hands 15 to 17 of the second display section for changing the display content.

Thus, the electronic timepiece 1 makes the rotation directions of the rotating plate 18 and the sub-hands 15 to 17, which rotate simultaneously in the small windows 7 and 5 arranged next to one another, opposite to one another, and accordingly performs dynamic operation which brings an image of rotation of engaged gear wheels, and can reduce simplicity and monotonousness of the display state and the change thereof more effectively.

Preferred embodiments are not limited to the above embodiment or modifications and can be modified in a variety of aspects.

For example, in the above embodiment and modifications, the rotating plate 18, 181, 182 or the like is rotated in relation to the fixed section (small window 7), which serves as a reference. Alternatively, both the rotating plate and the opening parts or the like may be rotated to change their positions relatively to one another.

Further, in the above embodiment and modifications, the rotating plate 18, 181, 182 or 183 is disk-shaped or arc-shaped. However, the rotating plate is not limited to those having a circumferential periphery portion. As far as the rotating plate can be arranged on the dial 3 and can perform appropriate cyclic display, it may have any shape.

Further, in the above embodiment and modifications, for example, the small window 7 or the rotating plate 181 is simply divided into the area marks 7*a* or the figure patterns 181*a* and the other regions (i.e. one cycle is divided into two regions). However, one cycle may be divided into three or more regions, may be formed by including gradations or the like, or may be provided with more complex figure (s), design (s), letter mark (s) and/or the like.

Further, in the above embodiment, the rotating plate 18 is used for displaying change in the counting time and displaying change in ON and OFF of the alarm setting. However, the rotating plate 18 may also be used for displaying measurement values obtained by using a physical sensor, and displaying operations of a communication unit, a radio wave receiver and so forth and their settings, for example.

Further, in the above embodiment, the rotating plate 18 is rotated in tune with change in the positions indicated by the sub-hands 15 to 17, but may be rotated by being linked with another/other indicator (s). Further, in the above embodiment, the rotating plate 18 displays the remaining amount of the battery 71 without being linked with another/other indicator (s) performing display. However, the same display may also be performed by the second hand 11 or the like, so that any kind of display may not be performed by the rotating plate 18 alone.

Further, in the above embodiment, the rotating plate 18 changes one cycle (rotation) of display in the elapsed time of 120 minutes, but is not limited thereto. The change may be made in the elapsed time of 60 minutes or in units of seconds depending on the type of the counting time.

Further, in the above embodiment, the rotation speed of the rotating plate 18 is changed before or after the sub-hands 15 to 17, which are linked with the rotating plate 18, finish moving (rotating) so as to be different between before and after the sub-hands 15 to 17 finish moving (rotating), but may be changed at other timing. For example, the rotation speed of the rotating plate 18 may be gradually reduced right before the rotating plate 18 reaches an angular position as a destination.

Further, in the above embodiment, the rotation direction of the rotating plate 18 is fixed or determined in advance on the basis of the rotation direction of the sub-hands 15 to 17, which are linked with the rotating plate 18, or the like, but may not be determined in advance. For example, the rotating plate 18 may be rotated simply in a direction in which the rotating plate 18 reaches an angular position as a destination fastest, or may be rotated by selecting an angular position and a direction to and in which the rotating plate 18 reaches, taking approximately the same time as the sub-hands 15 to 17.

Further, the components in the above embodiment and modifications can be combined in any aspect as far as they are consistent/compatible with one another.

In addition, the specific details, such as the components, the control procedure and the display examples, described in the above embodiment and modifications, can be appropriately modified without departing from the scope of the preset invention.

In the above, several embodiments and/or modifications are described. However, the scope of the present invention is not limited thereto, and includes the scope of claims below and the scope of their equivalents.

What is claimed is:

1. An electronic timepiece comprising:

a dial defining a first window and a second window;

a first display section comprising:

a fixed section comprising a predetermined number of a plurality of marks cyclically disposed; and a first rotatable part comprising the predetermined number of a plurality of parts, wherein each part of the plurality of parts is configured to rotate relative to the fixed section such that each of the plurality of parts rotating stepwise relative to a corresponding two adjacent marks of the plurality of marks form one display pattern of the predetermined number of same display patterns, and wherein each of stepwise positions of the plurality of parts are simultaneously visible through the first window of the dial;

a second display section comprising a second rotatable part, wherein the second rotatable part is configured to rotate stepwise through a plurality of angular positions to complete a full rotation of the second rotatable part, and wherein each of stepwise positions of the second rotatable part are simultaneously visible through the second window of the dial; and a processor configured to:

control the second rotatable part to rotate stepwise through the plurality of angular positions of the second rotatable part to display a cyclical change of a second display content;

control the first rotatable part to rotate the each of the plurality of parts stepwise through a predetermined plurality of phases between the corresponding two adjacent marks, wherein the predetermined plurality of phases correspond to a predetermined amount of change to the angular position of the second rotatable part;

receive selection of one of a plurality of display functions of the second display section; and in controlling the first rotatable part to rotate the each of the plurality of parts stepwise through the predetermined plurality of phases between the corresponding two adjacent marks, set the first rotatable part to a first of the predetermined plurality of phases in response to a first of the plurality of display functions being selected, and set the first rotatable part to a second of the predetermined plurality of phases in response to a second of the plurality of display functions being selected.

2. The electronic timepiece according to claim 1, wherein the first rotatable part is a rotating plate including the predetermined number of the plurality of parts cyclically disposed.

3. The electronic timepiece according to claim 1, wherein the processor is configured to control the second rotatable part to change the angular position of the second rotatable part to display the cyclical change of the second display content according to predetermined counting time.

4. The electronic timepiece according to claim 3, wherein the predetermined counting time includes time in a predetermined region.

5. The electronic timepiece according to claim 1, wherein the processor is configured to change a rotation speed of the first rotatable part so as to be different between before and after the second display section finishes changing the angular position of the second rotatable part to display the cyclical change of the second display content.

6. The electronic timepiece according to claim 1, wherein the processor is configured to control the first rotatable part to rotate the each of the plurality of parts stepwise through the predetermined plurality of phases in a rotation direction opposite to a rotation direction of the second rotatable part to change the angular position of the second rotatable part to display the cyclical change of the second display content.

* * * * *